US006056870A

United States Patent [19]

Reed et al.

[11] Patent Number: 6,056,870

[45] Date of Patent: May 2, 2000

[54] METHOD OF PROMOTING THE DECOMPOSITION OF SILICON COMPOUNDS IN A PROCESS FOR DEPOSITING SILICON UPON A METAL SURFACE

[76] Inventors: Larry E. Reed, 1732 SE. East Dr.; Ronald E. Brown, 6419 Quail Ridge Rd., both of Bartlesville, Okla. 74006; Timothy P. Murtha, Rte. 2, Box 1370, Bartlesville, Okla. 74003; Timothy P. Harper, 4964 SE. Brookline Dr., Bartlesville, Okla. 74006; James P. Degraffenried, 120 NE. Avondale, Bartlesville, Okla. 74006; Mark D. Scharre, 2809 Claremont Dr., Bartlesville, Okla. 74006; Gil J. Greenwood, 1429 S. Shawnee, Bartlesville, Okla. 74003

[21] Appl. No.: 08/296,307

[22] Filed: Aug. 25, 1994

[51] Int. Cl.[7] ..... C10G 9/16

[52] U.S. Cl. ..... 208/48 R; 208/48 AA; 585/950

[58] Field of Search ..... 208/48 R, 48 AA; 585/950

[56] References Cited

U.S. PATENT DOCUMENTS

| | | | |
|---|---|---|---|
| 4,404,087 | 9/1983 | Reed et al. | 208/48 AA |
| 4,692,234 | 9/1987 | Porter et al. | 208/48 |
| 4,696,702 | 9/1987 | Ellis, Jr. et al. | 437/88 |
| 4,696,834 | 9/1987 | Varaprath | 437/222 |
| 5,084,543 | 1/1992 | Frances et al. | 528/58 |
| 5,284,994 | 2/1994 | Brown et al. | 585/648 |

*Primary Examiner*—Bekir L. Yildirim
*Attorney, Agent, or Firm*—Charles W. Stewart

[57] ABSTRACT

For a given percentage decomposition, the decomposition temperature of an organosilicon compound is reduced by admixing with the organosilicon compound a decomposition promoting organotin compound. The amount of decomposition promoting organotin compound admixed with the organosilicon compound is sufficient to effectively lower the decomposition temperature of the organosilicon required for a given percentage decomposition.

14 Claims, 1 Drawing Sheet

Figure 1:
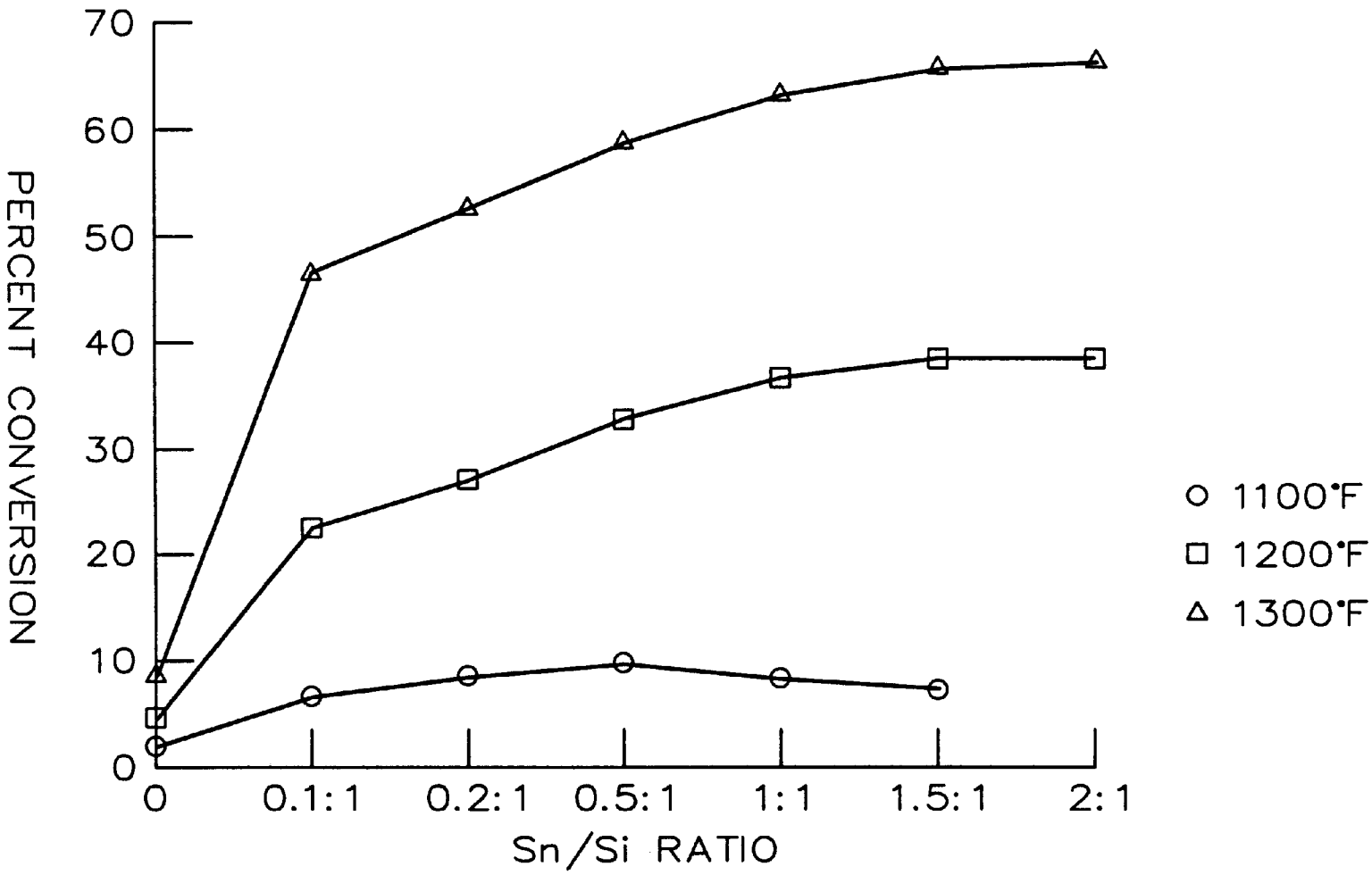

METHOD OF PROMOTING THE DECOMPOSITION OF SILICON COMPOUNDS IN A PROCESS FOR DEPOSITING SILICON UPON A METAL SURFACE

The present invention relates to the promotion of the decomposition of organosilicon compounds in order to deposit silicon upon a metal surface.

In a process for producing olefin compounds, a fluid stream containing a saturated hydrocarbon such as ethane, propane, butane, pentane, naphtha, or mixtures of two or more thereof is fed into a thermal (or pyrolytic) cracking furnace. A diluent fluid such as steam is usually combined with the hydrocarbon feed material being introduced into the cracking furnace.

Within the cracking furnace, the saturated hydrocarbons are converted into olefinic compounds. For example, an ethane stream is introduced into the cracking furnace wherein it is converted into ethylene and appreciable amounts of other hydrocarbons. A propane stream is introduced into the cracking furnace wherein it is converted to ethylene and propylene, and appreciable amounts of other hydrocarbons. Similarly, a mixture of saturated hydrocarbons containing ethane, propane, butane, pentane and naphtha is converted to a mixture of olefinic compounds containing ethylene, propylene, butenes, pentenes, and naphthalene. Olefinic compounds are an important class of industrial chemicals. For example, ethylene is a monomer or comonomer for making polyethylene. Other uses of olefinic compounds are well known to those skilled in the art.

A semi-pure carbon which is termed "coke" is formed in the cracking furnace as a result of the furnace cracking operation. Coke is also formed in the heat exchangers used to cool the gaseous mixture flowing as an effluent from the cracking furnace. Coke formation generally results from a combination of a homogeneous thermal reaction in the gas phase (thermal coking) and a heterogeneous catalytic reaction between the hydrocarbon in the gas phase and the metals in the walls of the cracking tubes or heat exchangers (catalytic coking).

Coke generally forms on the metal surfaces of the cracking tubes which are contacted with the feed stream and on the metal surfaces of the heat exchangers which are contacted with the gaseous effluent from the cracking furnace. However, it should be recognized that coke may also form on connecting conduits and other metal surfaces which are exposed to hydrocarbons at high temperatures. Thus, the term "Metals" will be used hereinafter to refer to all metal surfaces of the equipment in a cracking process system which are exposed to hydrocarbons and which are subject to coke deposition.

A normal operating procedure for a cracking furnace is to periodically shut down the furnace in order to burn out the deposits of coke. This downtime results in a substantial loss of production. In addition, coke is an excellent thermal insulator. Thus, as coke is deposited, higher furnace temperatures are required to maintain the gas temperature in the cracking zone at a desired level. Such higher temperatures increase fuel consumption and will eventually result in shorter tube life.

There are certain methods known by those skilled in the art for inhibiting or reducing the formation of coke on Metals. For instance, in U.S. Pat. No. 4,692,234 a method for reducing the formation of coke on the metal surfaces of a cracking process system is described whereby such metal surfaces are treated with an Antifoulant containing tin and silicon. One problem associated with the treatment of the metal surfaces of cracking process system equipment is the inability to properly coat the metal surfaces with silicon. This coating provides for the reduction of fouling of the Metals of an olefin cracking system. When treating the Metals, an organosilicon compound is converted at a given temperature when brought into contact with the Metals so as to deposit silicon thereon. Due to the temperature profiles within a cracking furnace, it also can be desirable to lower the decomposition temperature of the organic silicon compound.

It is thus an object of this invention to provide a method for promoting the decomposition of an organosilicon compound so as to enhance or improve the deposition of silicon upon the metal surfaces of cracking process system equipment.

It is another object of the invention to provide a method for controlling the temperature at which an organosilicon compound decomposes in order to improve the laydown of silicon upon the metal surfaces of cracking process system equipment.

In accordance with the present invention, a method is provided which promotes the decomposition of an organosilicon compound. The organosilicon compound has a decomposition temperature required to achieve a certain percentage decomposition when the organosilicon compound is used to deposit silicon upon a metal surface particularly the metal surfaces of cracking process system equipment. The method includes admixing with the organosilicon compound a decomposition promoting organotin compound, comprising organotin, in an amount that is effective in lowering the decomposition temperature of the organosilicon compound. This lowered decomposition temperature provides for a substantially equivalent percentage decomposition of the organosilicon compound as is provided when the organosilicon compound is used alone and without the decomposition promoting organotin compound. The admixture of organosilicon and decomposition promoting organotin compound can then be contacted with the Metals to thereby deposit silicon thereon. The contact temperature is lower than that required for organosilicon alone.

Other objects and advantages of the invention will be apparent from the description of the invention and the claims as well as the detailed description of the drawings in which:

FIG. 1 includes plots of the percent conversion at various decomposition temperatures of an organosilicon compound versus the weight ratio of elemental tin to elemental silicon in the antifoulant.

The invention is a method for promoting the decomposition or conversion of an organosilicon compound, particularly when it is used as an antifoulant in the tubes of a cracking furnace, so as to deposit a layer of silicon upon the metal surfaces of such tubes. It has been discovered that, unexpectedly, the decomposition temperature of organosilicon is lowered by the presence of a decomposition promoting organotin compound.

The reaction mechanism induced by the presence of the decomposition promoting organotin compound is unknown. The unexpected nature of the benefits resulting from the presence of organotin with organosilicon is demonstrated by the art not providing a clear explanation as to why such presence has the effect of lowering the decomposition temperature of organosilicon. But, it is clear from the description herein that the decomposition or conversion of organosilicon can be promoted through the utilization of the decomposition promoting organotin compound.

The use of the decomposition promoting organotin compound provides benefits in several ways; such as, for example, in the case where an essentially one hundred percent conversion of organosilicon is desired, its use results in a reduction or lowering of the required decomposition temperature of the organosilicon. Moreover, in the situation where one hundred percent conversion of organosilicon is not necessarily desired or required, for a given percent conversion or decomposition of organosilicon, the decomposition temperature can be lowered through the use of the decomposition promoting organotin compound while still achieving substantially the same given percent conversion or decomposition. These characteristics provide an ability to control the decomposition temperature of organosilicon, or the percent decomposition, by adjusting the amount of decomposition promoting organotin compound utilized or admixed with organosilicon. Not only is flexibility provided through the ability to control the decomposition temperature of organosilicon, but the energy costs associated with the treatment of the Metals can be reduced by lowering the required treatment temperature through a reduced decomposition temperature of the organosilicon utilized in the treatment.

Any suitable organosilicon compound can be used in the treatment of the Metals; provided, such compounds decompose under appropriate treatment conditions to provide a deposited layer of silicon upon the Metals.

Examples of organic silicon (organosilicon) compounds that may be used include compounds of the formula

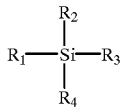

wherein $R_1$, $R_2$, $R_3$, and $R_4$ are selected independently from the group consisting of hydrogen, halogen, hydrocarbyl, and oxyhydrocarbyl and wherein the compound's bonding may be either ionic or covalent. The hydrocarbyl and oxyhydrocarbyl radicals can have from 1–20 carbon atoms which may be substituted with halogen, nitrogen, phosphorus, or sulfur. Exemplary hydrocarbyl radicals are alkyl, alkenyl, cycloalkyl, aryl, and combinations thereof, such as alkylaryl or alkylcycloalkyl. Exemplary oxyhydrocarbyl radicals are alkoxide, phenoxide, carboxylate, ketocarboxylate and diketone (dione). Suitable organic silicon compounds include trimethylsilane, tetramethylsilane, tetraethylsilane, triethylchlorosilane, phenyltrimethylsilane, tetraphenylsilane, ethyltrimethoxysilane, propyltriethoxysilane, dodecyltrihexoxysilane, vinyltriethyoxysilane, tetramethoxyorthosilicate, tetraethoxyorthosilicate, polydimethylsiloxane, polydiethylsiloxane, polydihexylsiloxane, polycyclohexylsiloxane, polydiphenylsiloxane, polyphenylmethylsiloxane, 3-chloropropyltrimethoxysilane, and 3-aminopropyltriethoxysilane. At present hexamethyldisiloxane is preferred.

Any suitable organotin compound can be utilized as the decomposition promoting organotin compound; provided, it effectively lowers the decomposition temperature of the organosilicon compound it is exposed to, or combined with, or admixed with, so as to give a reduced decomposition temperature for the organosilicon compound required to achieve a given percentage decomposition.

Examples of some organic tin compounds which can be used include tin carboxylates such as stannous formate, stannous acetate, stannous butyrate, stannous octoate, stannous decanoate, stannous oxalate, stannous benzoate, and stannous cyclohexanecarboxylate; tin thiocarboxylates such as stannous thioacetate and stannous dithioacetate; dihydrocarbyltin bis(hydrocarbyl mercaptoalkanoates) such as dibutyltin bis(isoocylmercaptoacetate) and dipropyltin bis(butyl mercaptoacetate); tin thiocarbonates such as stannous O-ethyl dithiocarbonate; tin carbonates such as stannous propyl carbonate; tetrahydrocarbyltin compounds such as tetrabutyltin, tetraoctyltin, tetradodecyltin, and tetraphenyltin; dihydrocarbyltin oxides such as dipropyltin oxide; dibutyltin oxide, dioctyltin oxide, and diphenyltin oxide; dihydrocarbyltin bis(hydrocarbyl mercaptide)s such as dibutyltin bis(dodecyl mercaptide); tin salts of phenolic compounds such as stannous thiophenoxide; tin sulfonates such as stannous benzenesulfonate and stannous-p-toluenesulfonate; tin carbamates such as stannous diethylcarbamate; tin thiocarbamates such as stannous propylthiocarbamate and stannous diethyldithiocarbamate; tin phosphites such as stannous diphenyl phosphite; tin phosphates such as stannous dipropyl phosphate; tin thiophosphates such as stannous O,O-dipropyl thiophosphate, stannous O,O-dipropyl dithiophosphate and stannic O,O-dipropyl dithiophosphate, dihydrocarbyltin bis(O,O-dihydrocarbyl thiophosphate)s such as dibutyltin bis(O,O-dipropyl dithiophosphate); and the like. At present tetramethyltin is preferred.

In the inventive method, the metal surfaces of the equipment of a cracking process system, preferably the tubes of a cracking furnace, are treated by contacting an organosilicon compound therewith under conditions suitable for inducing the decomposition of the organosilicon to thereby deposit silicon upon the metal surfaces. The metal surfaces of the cracking process system equipment, specifically, the cracking tubes, generally define a reaction zone wherein cracking reactions occur and the organosilicon compound is injected for the purpose of depositing silicon upon the surfaces which define such reaction zone. Thus, temperature and pressure conditions necessary for the cracking of hydrocarbons and for the decomposition of the organosilicon compound referred to herein will be those within the reaction zone defined by the cracking process system equipment.

To lower the decomposition temperature of the organosilicon compound used to treat the Metals, a decomposition promoting organotin compound, comprising an organotin compound, is admixed, or added, or combined, by any suitable manner with the organosilicon compound being contacted with the metal surfaces of the reaction zone. The amount of decomposition promoting organotin compound admixed with the organosilicon compound is sufficient to lower the decomposition temperature of the organosilicon compound to a reduced decomposition temperature required to achieve a given percentage decomposition of the organosilicon compound. The amount of decomposition promoting organotin compound to be admixed with the organosilicon compound, generally, should be such that the admixture comprising the organosilicon compound and the decomposition promoting organotin compound contains an atomic ratio of elemental tin (Sn) to elemental silicon (Si), hereafter "Sn/Si", of at least about 0.2:1.

It has been discovered that, unexpectedly, an incremental improvement in the conversion or decomposition of the organosilicon compound is observed as the atomic ratio of Sn/Si is incrementally increased. The rate of improvement in the decomposition of the organosilicon compound for a given incremental increase in the Sn/Si atomic ratio decreases as the Sn/Si atomic ratio increases until it is about 1.5:1, at which point, there is very little, if any, improvement in the organosilicon compound decomposition that results from such incremental increase in the Sn/Si atomic ratio. Thus, for the best results, the Sn/Si atomic ratio in the admixture of organosilicon and decomposition promoting organotin can be in the range of from about 0.05:1 to about 1.5:1. Preferably, the Sn/Si atomic ratio can be in the range of from about 0.1:1 to about 1.25:1 and, most preferably, it can be from 0.15:1 to 1:1.

The admixture is contacted with the metal surface of the cracking process system equipment, preferably, the cracking furnace tubes, under conditions that suitably provide for the decomposition and laydown of silicon onto the Metals. As indicated above, the required temperature for the decomposition of the organosilicon compound will be a reduced decomposition temperature for the given percentage decomposition of the organosilicon compound, and it will be a function of the Sn/Si atomic ratio.

Generally, to obtain the heat energy benefit, it is desirable to have such a Sn/Si atomic ratio that provides, for a given percentage decomposition of the organosilicon compound, a differential between the decomposition temperature of the organosilicon compound when no organotin compound is present and the reduced decomposition temperature when the organotin compound is present (differential temperature) of at least about 10° F. From an energy standpoint alone, it is best to provide for as large a differential temperature as can effectively be induced by the presence of the decomposition promoting organotin compound with the organosilicon compound. The maximum obtainable differential temperature appears to be no more than about 500° F. Preferably, the differential temperature can be in the range of from about 20° F. to about 400° F. and, most preferably, from 30° F to 300° F.

In order to effectively treat the Metals, the organosilicon compound utilized must decompose so as to provide a deposit or layer of silicon upon such Metals. Thus, a certain minimum percentage decomposition of the organosilicon compound is required. Generally, it is desired for at least about 20 percent of the organosilicon to be converted. Preferably, the percentage decomposition can be at least about 30 percent. Most preferably, the percentage decomposition of the organosilicon compound can be at least 40 percent. To achieve a given percentage decomposition of the organosilicon composition, the contacting conditions such as temperature and Sn/Si ratio are controlled accordingly as is required.

The following examples are provided to further illustrate the present invention.

EXAMPLE I

This example describes the experimental procedure used to obtain organotin decomposition data.

The experimental apparatus included a 24' long, 16 pass coil made of ¼" O.D. Incolloy 800 tubing which was heated to the desired temperature (1100° F., 1200° F. and 1300° F.) in an electric tube furnace. Approximately five (5) standard liters of nitrogen and nine (9) liters of steam per minute were passed through the coil in order to provide a carrier, turbulence, and a fixed residence time for the compounds being tested. A Hewlett Packard gas chromatograph with fifteen (15) meters of a methyl silicone capillary column, a flame ionization detector, and an automatic sampling valve was used to analyze a portion of the coil effluent in order to determine percent conversion. Gas blends containing helium (He) and hexamethyldisiloxane (HMDO), and He and tetramethyltin (TMT) were introduced into the coil via flow controllers at a point two (2) feet from the inlet at which point the temperature conditions became substantially isothermal throughout the remaining length of the coil.

A blend of He and normal pentane was used as a calibration reference for the gas chromatograph. This blend bypassed the coil. Prior to the introducing the reactants to the coil, the HMDO and TMT blends bypass the coil and were ratioed against the normal pentane blend in order to establish a zero conversion baseline. Conversion is measured by the percent disappearance of the reactants verses the normal pentane blend which value remained constant.

After calibration, the HMDO flow was diverted from bypass and the TMT flow was turned off. Gas chromatograph sampling would take place automatically and conditions remained fixed until repeatable results were obtained. TMT was then introduced at a flow rate yielding a desired silicon per tin (Si/Sn) atomic ratio. Conditions were held as before and then the next desired ratio was set.

EXAMPLE II

The data presented in Table I is that obtained through use of the experimental procedure described in Example I and is graphically depicted in FIG. 1. The data show percent conversion of the organotin compound for various tube temperatures and for various tin per silicon (Sn/Si) atomic ratios. As can be observed from the data, for a given temperature, as the Sn/Si ratio increases the decomposition or conversion of the organosilicon compound increases. It is also noted that the incremental improvement in the decomposition of the organosilicon compound for a given incremental increase in the Sn/Si atomic ratio begins to decline at a Sn/Si atomic ratio of about 0.4:1, and at a Sn/Si atomic ratio exceeding 1.5:1 little or no benefit is provided. Thus, the Sn/Si atomic ratio is a critical variable in enhancing the decomposition of organosilicon.

As also can be seen from the data of Table I is that the decomposition temperature of the organosilicon compound can be lowered by use of the decomposition promoting organotin compound.

TABLE I

| | Organosilicon Decomposition | | |
|---|---|---|---|
| Sn/Si Ratio | Percent * Conversion at 1100° F. | Percent * Conversion at 1200° F. | Percent * Conversion at 1300° F. |
| 2:1 | | 38.43 | 66.18 |
| 1.5:1 | 7.19 | 38.35 | 65.73 |
| 1:1 | 8.37 | 36.78 | 63.16 |
| 0.5:1 | 9.88 | 32.89 | 58.85 |
| 0.2:1 | 8.44 | 27.07 | 52.58 |
| 0.1:1 | 6.61 | 22.50 | 46.47 |
| 0 | 2.03 | 4.67 | 8.55 |

* average of data points.

Reasonable variations and modifications are possible by those skilled in the art within the scope of the described invention and the appended claims.

What is claimed is:

1. A method of promoting the decomposition of an organosilicon compound, said organosilicon compound having a decomposition temperature required to achieve a given percentage decomposition, in a process for depositing silicon upon a metal surface, said method comprising the steps of:

admixing with said organosilicon compound an organotin compound in an amount effective to lower said decomposition temperature of said organosilicon compound to a reduced decomposition temperature required to achieve said given percentage decomposition to form an admixture; and contacting said admixture with said metal surface at said reduced decomposition temperature to thereby deposit silicon thereon.

2. A method as recited in claim 1 wherein said amount effective to lower said decomposition temperature is such as to provide an atomic ratio of elemental tin to elemental silicon in said admixture of at least about 0.2:1.

3. A method as recited in claim 1 wherein the difference between said decomposition temperature and said reduced decomposition temperature is at least about 10° F. for said given percentage decomposition.

4. A method as recited in claim 1 wherein said given percentage decomposition is at least 20 percent.

5. A method as recited in claim 1 wherein said given percentage decomposition is at least 40 percent and the difference between said decomposition temperature and said reduced decomposition temperature is at least about 25° F.

6. A method as recited in claim 1, wherein said organosilicon compound is hexamethyldisiloxane.

7. A method as recited in claim 1, wherein said organotin compound is tetramethyltin.

8. A method of promoting the decomposition of an organosilicon compound, said organosilicon compound having a decomposition temperature required to achieve a given percentage decomposition, in a process for depositing silicon upon a metal surface, said method comprising the steps of:

defining said given percentage decomposition:

admixing with said organosilicon compound an organotin compound in an amount such that the atomic ratio of elemental tin to elemental silicon in the resultant admixture is in the range of from about 0.05:1 to about 1.5:1; and contacting said admixture with said metal surface at a temperature which is below said decomposition temperature without reducing the percentage decomposition of said organosilicon compound below said given percentage decomposition to thereby deposit silicon on said metal surface.

9. A method as recited in claim 8 wherein the atomic ratio of elemental tin to elemental silicon in said admixture is at least about 0.2:1.

10. A method as recited in claim 8 wherein the difference between said decomposition temperature and said temperature is at least about 10° F. for said given percentage decomposition.

11. A method as recited in claim 8 wherein said given percentage decomposition is at least 20 percent.

12. A method as recited in claim 8 wherein said given percentage decomposition is at least 40 percent and the difference between said decomposition temperature and said temperature is at least about 25° F.

13. A method as recited in claim 8, wherein said organosilicon compound is hexamethyldisiloxane.

14. A method as recited in claim 8, wherein said organotin compound is tetramethyltin.

* * * * *